US005774773A

United States Patent [19]

Otsuka et al.

[11] Patent Number: 5,774,773

[45] Date of Patent: Jun. 30, 1998

[54] TONER BOTTLE AND TONER SUPPLYING APPARATUS USING THE SAME

[75] Inventors: Shinichi Otsuka; Hiromichi Miyoshi, both of Utsunomiya, Japan

[73] Assignee: Matsushita Electric Industrial Co., Ltd., Osaka, Japan

[21] Appl. No.: 815,761

[22] Filed: Mar. 12, 1997

[30] Foreign Application Priority Data

Mar. 13, 1996 [JP] Japan ..... 8-055736

[51] Int. Cl.[6] ..... G03G 15/08

[52] U.S. Cl. ..... 399/262; 222/167; 222/325; 222/DIG. 1; 399/120; 399/260

[58] Field of Search ..... 399/258, 260, 399/262, 252, 255, 105, 106, 120, 119; 222/DIG. 1, 167, 169, 325, 367, 414, 564, 565; 141/256, 363; 347/86

[56] References Cited

U.S. PATENT DOCUMENTS

| | | | |
|---|---|---|---|
| 4,212,264 | 7/1980 | Knechtel et al. | 399/261 |
| 4,878,603 | 11/1989 | Ikesue et al. | 222/167 |
| 5,057,872 | 10/1991 | Saijo et al. . | |
| 5,111,976 | 5/1992 | Ban | 222/485 |
| 5,128,724 | 7/1992 | Hayashi et al. | 399/119 |
| 5,296,900 | 3/1994 | Saijo et al. | 399/260 |
| 5,455,662 | 10/1995 | Ichikawa et al. | 399/260 |
| 5,481,344 | 1/1996 | Yasuda et al. | 399/120 |
| 5,502,553 | 3/1996 | Masuda et al. | 222/DIG. 1 X |
| 5,528,349 | 6/1996 | Satake | 399/262 |
| 5,576,816 | 11/1996 | Staudt et al. | 399/262 |
| 5,589,919 | 12/1996 | Ikunami et al. | 399/262 |
| 5,648,840 | 7/1997 | Ikunami et al. | 399/262 |

FOREIGN PATENT DOCUMENTS

| | | |
|---|---|---|
| 0 604 999 | 7/1994 | European Pat. Off. . |
| 0 689 104 | 12/1995 | European Pat. Off. . |
| 56-114969 | 9/1981 | Japan . |
| 4-1681 | 1/1992 | Japan . |
| 6-266227 | 9/1994 | Japan . |
| 2 268 725 | 1/1994 | United Kingdom . |

OTHER PUBLICATIONS

Patent Abstracts of Japan, vol. 095, No. 011, Dec. 26, 1995 & JP 07 199619 (Ricoh Co., Ltd) Aug. 4, 1995.

*Primary Examiner*—Arthur T. Grimley
*Assistant Examiner*—Sophia S. Chen
*Attorney, Agent, or Firm*—McDermott, Will & Emery

[57] ABSTRACT

The present invention relates to a toner bottle having a body with a convexly-shaped spiral rib continuously formed on the inside surface thereof and a tip with an opening for toner to flow therefrom. A section for joining the body and the tip includes a first circular face having a slope convex portion that slopes toward the inside, and a second circular face having a toner pump-up portion, the diameter of which is approximately same as that of the body. There is a shutter rotatably disposed on the tip to normally close the opening. The shutter has an opening that fits over the tip opening when the toner bottle is rotated inside the shutter. The shutter may be made of elastic material, and has arcs of different thicknesses. A thicker one of the arcs is used to keep the tip opening closed except when being used in a toner supplying apparatus. The toner bottle allows the toner to flow in a continuous manner, and prevents users from dirtying their hands when replacing toner bottles.

11 Claims, 9 Drawing Sheets

TONER BOTTLE AND TONER SUPPLYING APPARATUS USING THE SAME

BACKGROUND OF THE INVENTION

The present invention relates to a toner bottle, which supplies toner to a development device of an electrophotographic copier or a printer, and a toner supplying apparatus using the toner bottle.

Better copy quality has been demanded recently for electro-photographic copiers and printers. One of the measures for improving copy quality is to supply toner in a constant quantity automatically from a hopper to the development device.

A conventional toner supplying apparatus is described by referring to FIG. 1, which depicts a cross section of a toner supplying apparatus disclosed in laid open patent application number H04-1681. In FIG. 1, the frame 1 of a toner supplying apparatus is positioned above a development device 3. A toner bottle holder 5 is situated within the frame 1 with one end of the toner bottle holder 5 extending through the frame 1 and connected to a motor 8. One end or tip side of a toner bottle 2 is held in place by the toner bottle holder 5. A sealant 6 is seated between the toner bottle holder 5 and the frame 1. Another sealant 7 is seated between the toner bottle holder 5 and the toner bottle 2. A toner supplying roller 9 is positioned within the frame 1. The motor 8 is for rotating the toner bottle 2 via the toner bottle holder 5 and the toner supplying roller 9 via a gear 10. The toner bottle 2 contains toner 14 and has an opening 12 formed in the tip side of the toner bottle 2 for allowing the toner 14 to flow therefrom. An opening 13 is also formed in the toner bottle holder. The toner bottle 2 has a spiral rib 11 formed on inside wall thereof. A photosensitive drum is depicted by the numeral 4.

When the toner bottle 2 is rotated around a horizontal axis L by the motor 8, the toner 14 is moved to the opening 12 by a transferring force derived from the spiral rib 11 on the toner bottle 2. The spiral rib 11 formed on an inner wall of toner bottle 2 transfers the toner 14 toward the opening 12. The toner 14 falls through the bottle holder opening 13 into the frame 1 of the toner supplying apparatus. Finally, the supply roller 9 rotates to feed a specified quantity of toner to the development device 3.

When the toner bottle 2 empties, a user pulls out the toner bottle 2 and inserts a new toner bottle along the horizontal axis L as a replacement toner bottle. Since the opening 12 of toner bottle 2 slants, the toner bottle 2 contacts the sealant 7 when the toner bottle 2 is inserted completely into the toner bottle holder 5, thereby assuring a proper sealing.

However, the toner supplying apparatus disclosed in laid open patent application number H04-1681 has certain disadvantages or problems. Specifically, since a terminal of the spiral rib 11 is away from the opening 12, the quantity of toner that flows out of the opening 12 is reduced or becomes unstable when the quantity of toner in the bottle becomes low. The toner flows smoothly only when there is a substantial amount of toner in the bottle. However, when the quantity of toner in the bottle is lowered, the amount of toner flowing from the openings 12, 13 is reduced. This causes the toner density of the development device 3 to become unstable, thereby lowering copy quality.

Another disadvantage stems from the insertion of the toner bottle 2 into the toner bottle holder 5. Prior to insertion the opening 12 of the toner bottle 2 is covered by a thermal disposition sheet. The thermal disposition sheet must be peeled off before the toner bottle is mounted in the toner supplying apparatus. A user, therefore, handles the toner bottle 2 with an uncovered opening 12 prior to the bottle's insertion into the holder. As a result, the user dirties his/her hands or peripheral devices by spilling some toner from the opening 12.

Also, if the toner bottle 2 is removed from the apparatus with the opening 12 facing down, the toner left in the bottle gets spilled and dirties the toner supplying apparatus.

BRIEF SUMMARY OF THE INVENTION

The present invention changes the structure of the conventional toner bottle and aims to provide a toner bottle that can supply toner in stable and consistent manner when rotating the toner bottle.

The present invention also aims to provide a toner bottle that avoids dirtying a user's hands or peripheral devices when the toner bottle is inserted or removed to/from the bottle holder, by fitting the opening of the toner bottle exactly to the counterpart of the bottle holder.

The present invention further aims to provide a toner bottle from which the toner will not spill from its opening when the bottle is being handled.

A toner bottle according to the present invention comprises, a body having an inner surface on which a continuous convex and spiral rib is formed, a tip portion having a side on which an opening is formed, a main unit between the body and the tip portion, said main unit having a first circular face having a convex sloped toward the inside of the body and a second circular face having a toner pump-up part whose diameter is approximately the same as that of the body, and a shutter rotatably disposed on the tip portion where the bottle opening is formed, the shutter normally closing the tip opening, wherein the shutter fits the opening of the tip portion over another opening formed on a toner supplying means when the toner bottle is mounted in a toner supplying means.

Another toner bottle according to the present invention comprises, a toner bottle where an opening for toner flowing is disposed on its tip side, a shutter rotatably disposed for opening/closing the opening for toner flowing, wherein the shutter is made of elastic member and a part of the shutter is thicker than other parts so that the tip opening is closed by the thicker part of the shutter.

Still another toner bottle according to the present invention comprises, a toner bottle where an opening for toner flowing is disposed on its tip side, a shutter having an opening that fits over the counterpart opening disposed on the bottle tip side, this shutter being rotatably disposed to open and close the counterpart tip opening. The periphery of the tip opening disposed on the tip side of the bottle is made up thicker than other peripheries, and the shutter is made of elastic member. The shutter normally closes the opening disposed on the bottle tip side, and fits both openings to each other when the toner bottle is mounted to a toner supplying means.

Further, another toner bottle according to the present invention comprises, a toner bottle where an opening for toner flowing is disposed on its tip side, a shutter having an opening that fits over the counterpart tip opening disposed on the bottle tip side, the shutter being rotatably disposed to open and close the counterpart tip opening. The periphery of the opening disposed on the tip side of the bottle is made up thicker than other peripheries, and the shutter is made of elastic member. In this embodiment, the measurements of the tip and shutter have the following relationship: $R1>r1-e$, $r2>R2$, where R1 is the outer radius of the tip near the opening of the toner bottle, R2 is the outer radius near the toner bottle center, e is the distance of the deviation from the origin center of the circular arc of the shutter, and r1 is the inner radius having the center at e, r2 is the inner radius near the opening of the toner bottle.

Still further, another toner bottle according to the present invention comprises, a toner bottle where an opening for toner flowing is disposed on its tip side, a shutter having an opening that fits over the counterpart disposed on the bottle tip side, the shutter being rotatably disposed to open and close the counterpart, and a lid member detachably disposed at the tip of toner bottle, the lid member prevents the shutter from falling or coming off.

A toner bottle other than the above according to the present invention comprises, a toner bottle where an opening toner flowing is disposed on its tip side, a shutter having an opening that fits over the counterpart disposed on the bottle tip side, the shutter being rotatably disposed to open and close the counterpart, and an elastic member disposed on an inside wall of the shutter.

According to the present invention, the toner bottle comprises, a body in which the convex and spiral rib is continuously formed on the inner face, a tip whose side has the opening for toner flowing, a part of the toner bottle between the body and tip, where a first circular face has the slope convex toward inside of the bottle, and a second circular face for toner pump-up whose diameter is approximately same as that of the body, and a shutter rotatably disposed on the tip where the opening is formed, the shutter normally closes the opening, and having an opening thereon which fits over the opening of the toner bottle when the toner bottle is mounted to a toner supplying means.

An advantage of the present invention is obtained when mounting or removing the toner bottle to/from a toner supplying means. A user need not worry about dirtying his/her hands or peripheral devices. In particular, the above structure does not require a seal for covering the tip opening. Thus, the present invention saves the time it took to peel off the seal prior to inserting the toner bottle in a toner supplying device. The above structure also has the advantage of allowing toner to be supplied stably in a consistent and even manner by only rotating the toner bottle.

Another toner bottle according to the present invention comprises, an elastic member on the inner wall of the shutter so that the toner bottle may have an improved airtightness between the outside of the tip and the inside of the shorter, as well as permitting the tip to slide more freely inside the shutter by reducing the friction therebetween.

The invention itself, together with further objects and attendant advantages, will best be understood by reference to the following detailed description taken in conjunction with the accompanying figures.

DETAILED DESCRIPTION OF THE INVENTION

Figure 1:
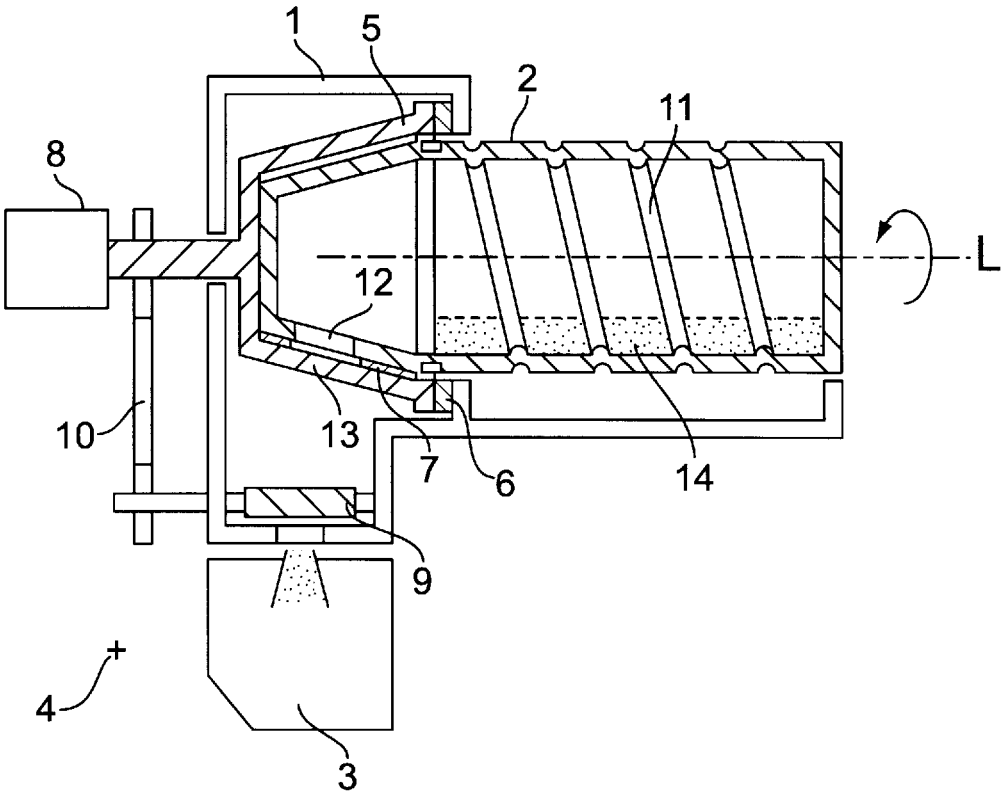
FIG. 1 PRIOR ART
FIG. 1 is a cross section of a conventional toner supplying apparatus.

An exemplary embodiment of the present invention is described by referring to the drawings attached.

Figure 2:
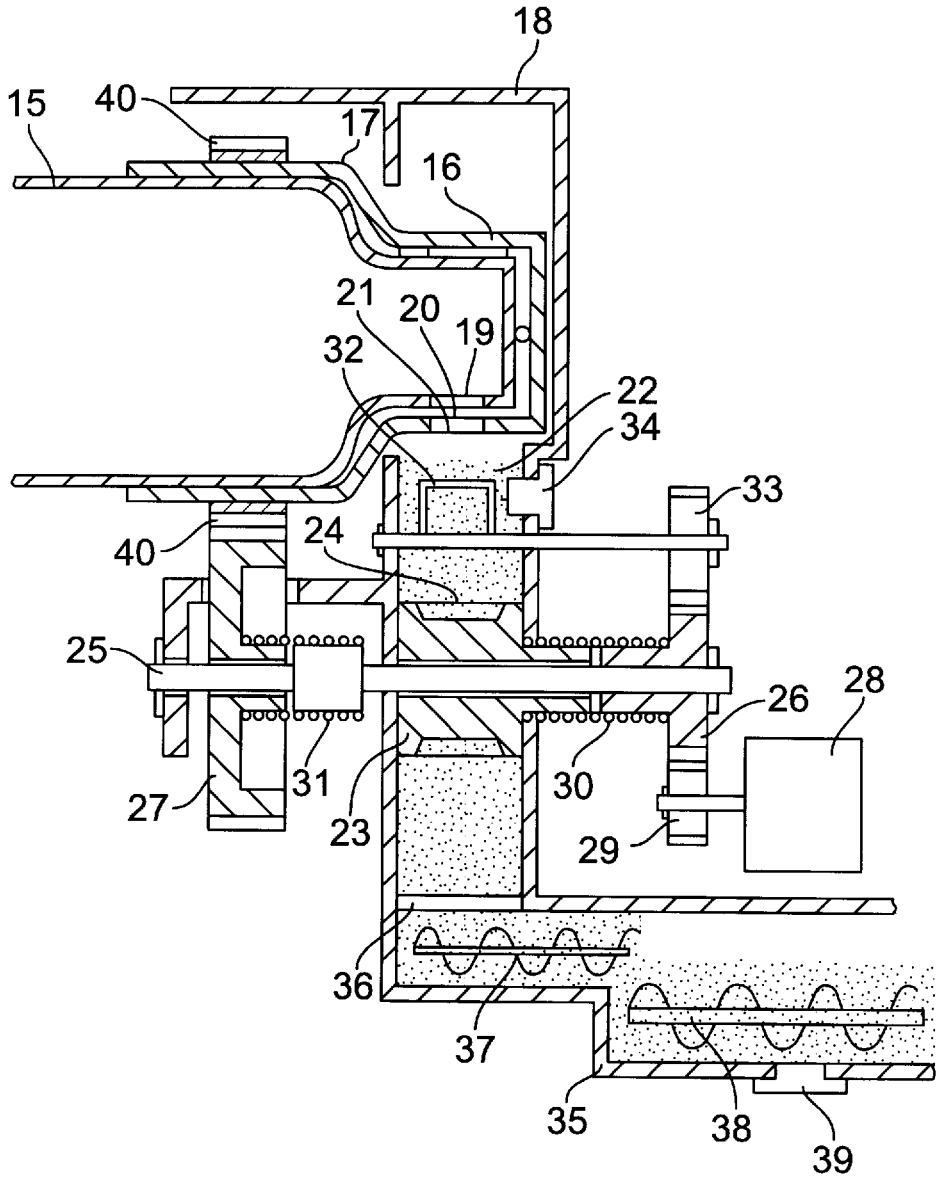
FIG. 2 is a cross section of a toner supplying apparatus using a toner bottle of the present invention.

FIG. 2 is a cross section of the toner supplying apparatus of the present invention. In FIG. 2, there is shown a toner bottle holder 17, which holds and rotates a toner bottle 15 containing toner(not shown). The toner bottle has an opening 19. The toner bottle holder has an opening 21. A shutter 16 is mounted to the tip of the toner bottle. The shutter has an opening 20. A hopper 18 holds the toner bottle holder 17 in a manner that permits the toner bottle holder to rotate. The hopper 18 also receives the toner 22 supplied by the toner bottle via the openings 19, 20 and 21.

When the toner bottle 15 is mounted to the toner bottle holder 17, the opening 19 on the toner bottle, the opening 20 on the shutter, and the opening 21 on the toner bottle holder 17 coincide with each other and allow the toner 22 to be supplied to the hopper 18.

A toner supplying roller 23 having plural notches 24 thereon is disposed in the hopper 18. The toner supplying roller 23 has a shaft 25. One end of the shaft 25 has a roller gear 26 thereon. Another end of the shaft 25 has a toner bottle holder gear 27 for rotating the toner bottle holder. A motor 28 is use to rotate the shaft 25. In particular, a driving gear 29 of the motor 28 engages the roller gear 26 so that the rotation can be transmitted to the shaft 25. A spring-loaded clutch 30 is wound around the bosses of the toner supplying roller 23 and the roller gear 26 for transmitting a rotation driving force via the roller gear 26 when the motor 28 rotates in a forward direction. A spring-loaded clutch 31 is wound around the bosses of the shaft 25 and the toner bottle holder gear 27 transmitting a rotation driving force when the motor 28 rotates in a reverse direction. Thus, the toner supplying roller rotates independently when the motor 28 rotates forward, and the toner bottle holder gear 27 rotates independently when the motor 28 rotates in reverse.

A cleaner 32 is rotated by the rotation of the toner supplying roller gear 26 via a driving gear 33 so that the cleaner 32 can clean the surface of a toner-remains-sensor 34.

There is a development device 35 having an opening 36 in the lower portion of the hopper 18 for receiving the toner supplied to the lower portion of the hopper 18. Also, a screw 37 for feeding toner is situated in the lower portion of the hopper. Further, a screw 38 for agitating developing powder is situated adjacent the feeding screw 37. A toner density sensor 39 is situated at the bottom of the development device 35.

A gear 40 mounted to the toner bottle holder 17 is so structured that the toner bottle holder gear 27 rotates the mounted toner bottle 15.

Figure 3:
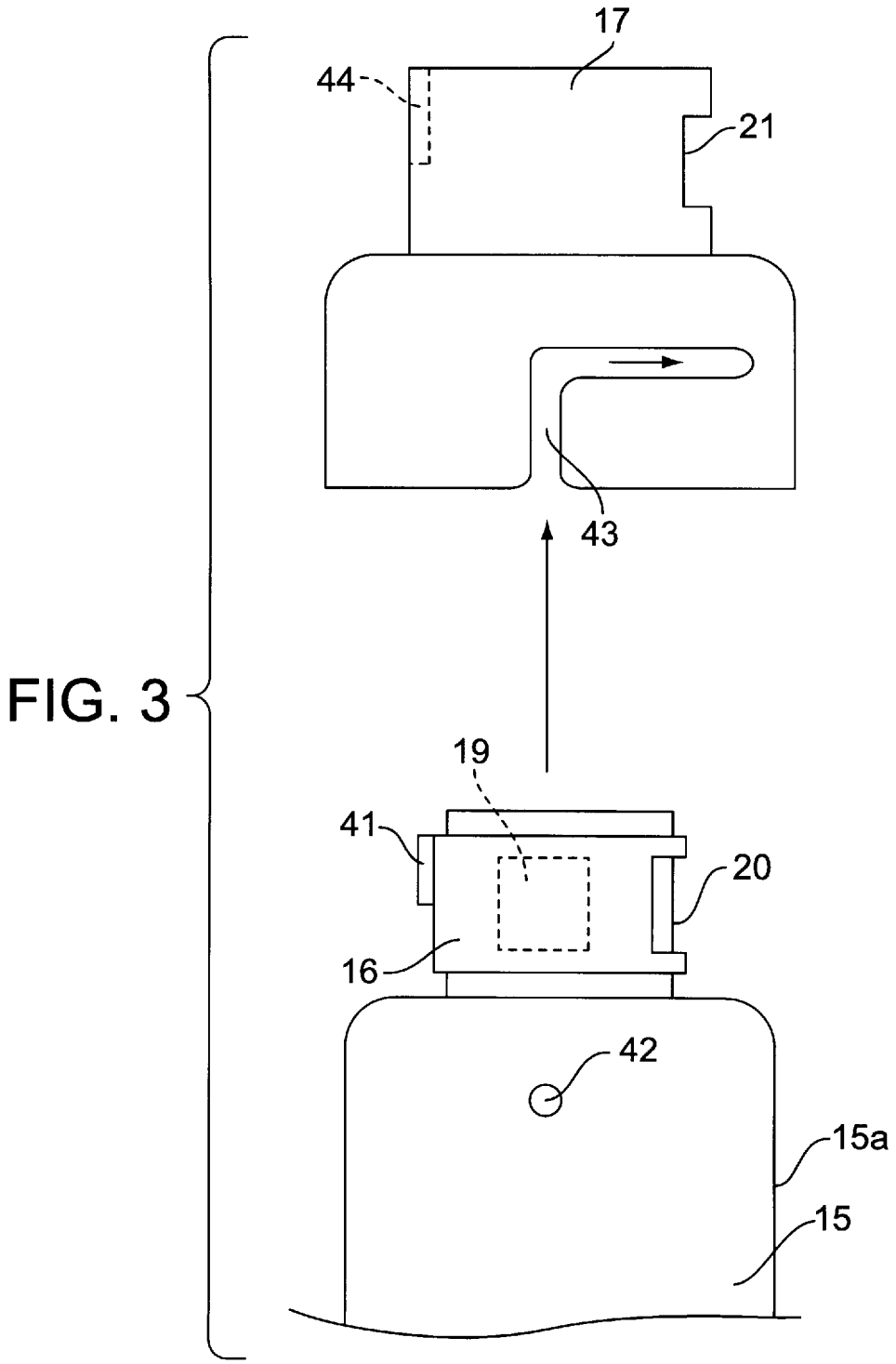
FIG. 3 is a side view depicting how to mount/remove the toner bottle of the present invention.

FIG. 3 depicts side views of the toner bottle 15, the ring shutter 16, and the toner bottle holder 17. As depicted in FIG. 3, the toner bottle 15 has a body portion and a tip portion. The tip portion has an opening 19. Below the opening 19, there is a protrusion 42 on the main portion of the toner bottle 15. The ring shutter 16 is rotatably disposed at the tip of toner bottle 15. Normally, the ring shutter 16 closes the opening 19 and prevents the toner from flowing out of the shutter's opening 20. There is an opening 20 disposed on the ring shutter 16, which is shaped and sized to complement the opening 19, for allowing toner to flow from the toner bottle when the ring shutter 16 is rotated to a position where the opening 20 is disposed over the opening 19. An engaging protrusion 41 is formed on the ring shutter 16. The toner body holder 17 is shaped and sized to fit over toner bottle with the ring shutter 16 in place on the tip portion of the bottle. The toner bottle holder has a lower portion with an inner diameter larger than the diameter of the outer diameter of the toner bottle. On the side of the lower portion of the toner bottle holder 17, there is formed an L-shape groove 43 for engagement with the protrusion 42 on the toner bottle 15. Further, the toner bottle holder 17 has an upper or tip portion with an inner diameter larger than the diameter of the outer diameter of the ring shutter 16. On the inside of the upper portion of the toner bottle holder 17, there is formed a convexly-shaped slit 44 for engagement with the protrusion 41 on the ring shutter 16. Also, there is an opening 21 disposed on the upper portion of the toner bottle holder 17, which is shaped and sized to complement the opening 20 on the ring shutter, for allowing toner to flow from the toner bottle when the ring shutter 16 is rotated to a position where the opening 20 is disposed over the opening 19 in the toner bottle 15.

When the toner bottle 15 is inserted into the toner bottle holder 17, the protrusion 42 is guided by the L-shape groove 43 to engage the toner bottle 15 with the toner bottle holder 17. Then the engaging protrusion 41 of the ring shutter 16 engages the convex slit 44 on the inside of toner bottle holder 17 to keep the ring shutter 16 from rotating relative to the toner bottle holder. However, the toner bottle 15 is free to rotate within the confines of the L-shaped slit 43 until the opening 19 in the toner bottle becomes aligned with the opening 20 in the ring shutter.

As a result, the opening 19 coincides with the opening 20, which in turn coincides with the opening 21, and the toner bottle becomes mounted in the toner bottle holder 17 in a position that allows toner to flow from the toner bottle 15. When the above procedure is reversed the toner bottle. 15 can be removed for replacement with another toner bottle. The arrangement just described has the advantage of keeping a toner bottle's opening 19 closed by the ring shutter 16 whenever a toner bottle is mounted or removed to/from the toner bottle holder 17, thus preventing the toner from spilling. As a result, users need not worry about dirtying their hands as well as dirtying the periphery devices. This arrangement also provides the advantage of eliminating the need to put a thermal deposition seal over the opening on a toner bottle. This saves time that was needed for peeling off the seal and facilitates the replacement of the toner bottles.

Now returning to FIG. 2, the present invention utilizes a toner density sensor 39 for detecting any lowering of the toner density of the development device 35, as sheets are being copied. When a change in toner density is detected, a detection signal is sent to the motor 28 to rotate the motor forward. The motor's rotation is transmitted via the driving gear 29 to the toner supplying roller gear 26 to rotate the shaft 25. Since the spring-loaded clutch 30 is disposed between the toner supplying roller gear 26 and the toner supplying roller 23, the rotation of shaft 25 is transmitted to the toner supplying roller 23, and the toner 25 in the notch 24 of the toner supplying roller 23 is supplied to the development device 35. Then, when the toner density sensor 39 detects an appropriate toner density, the motor 28 stops to end the supplying of toner to the toner development device 35.

The present invention also utilizes a toner remaining sensor 34 for detecting any lowering of the quantity of toner in the hopper 18. When a change in the quantity of toner is detected, a detection signal is sent to the motor 28 to rotate the motor in a reverse direction, which rotates the toner supplying roller gear 26 also in reverse. However, the reverse rotation is not transmitted to the toner supplying roller 23 because the spring-loaded clutch 30 slips. Instead, the spring-loaded clutch 31 is reversely wound between the shaft 25 and the toner bottle holder 27. Thus the rotation driving force is transmitted therebetween to the gear 40 to rotate the toner bottle holder 17 and thus, the toner bottle 15.

The toner bottle 15, as described in detail subsequently, has a continuous and convex spiral rib 45 on the inside thereof. When the toner bottle 15 rotates, the toner 22 inside the bottle moves toward the opening 19, and is supplied through the openings 20 and 21 to the hopper 18.

The toner bottle 15 rotates once and stops. Then, the motor 28 rotates in reverse to supply the toner 22 from the toner bottle 15 to the hopper 18 until the toner remaining sensor 34 detects that the quantity of toner has reached a specified quantity. The detection level of the toner remaining sensor 34 is set to detect a point where the toner quantity level remains below the inner wall height of hopper 18 even after toner has been added following one rotation of the toner bottle 15. Therefore, the toner 22 never overflows the hopper 18.

Figure 4A:
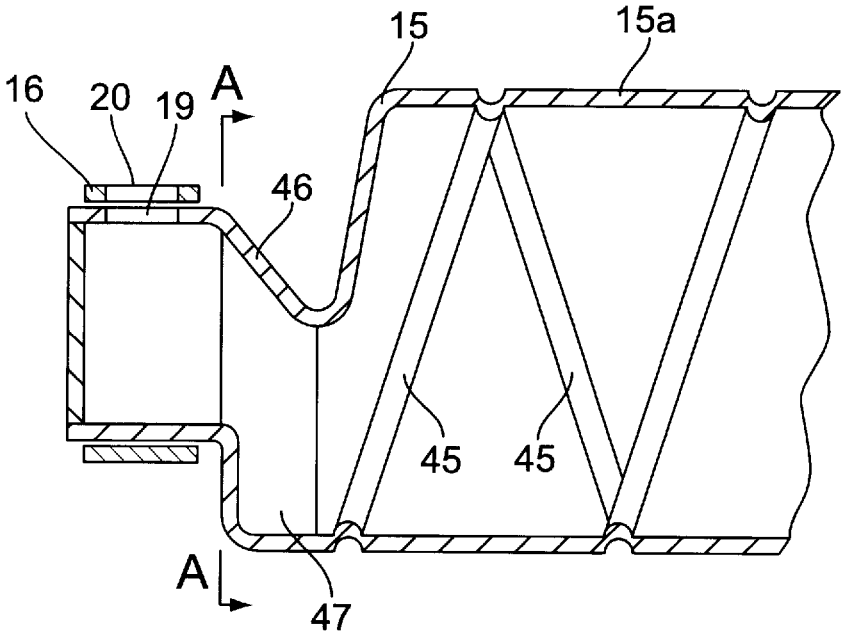
FIGS. 4(*a*) and 4(*b*) are cross sections of the toner bottle of the present invention.
Figure 4B:
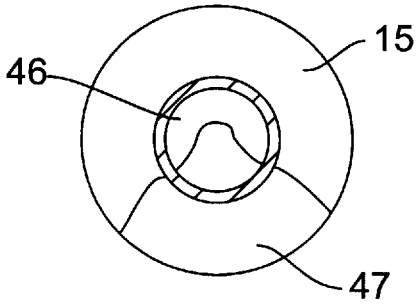

The structure of toner bottle 15, according to the present invention, is described by referring to FIG. 4(*a*) and FIG. 4(*b*). FIG. 4(*a*) is a cross section of an essential part of the toner bottle according to the present invention. FIG. 4(*b*) is a cross section of FIG. 4(*a*) taken along the line A—A. As pointed out above, the shutter 16 is rotatably disposed at the tip of toner bottle 15. The opening 19 of the toner bottle 15 is normally closed by the shutter 16. A continuous, spiral rib 45 is formed on the inside of the body 15*a* of the toner bottle 15. Thus, when the toner bottle 15 rotates, the toner inside the bottle moves toward the opening 19. Between the body 15*a* and the opening 19, there is a section joining the body 15*a* and the tip. The section has a slope 46, which is convex in shape sloping toward the inside of the body 15*a* and that is formed on a part of the section, and having a toner pump-up part 47, which has a diameter that is approximately the same as that of the body 15*a* and that is formed on the side of the section opposite from the slope 46. As shown in FIG. 4(*a*), when the toner pump-up part 47 is at a lower side or below a horizontal plane, the toner moved by the spiral rib 45 stays in the toner pump-up part 47. However, when the toner bottle 15 rotates and the toner pump-up part 47 rises to an upper side or above a horizontal plane with the opening 19 of the toner bottle 15 in the position shown in FIG. 2, the toner in the pump-up part 47 falls toward the slope 46 and slips on the slope 46 to the opening 19 permitting the toner to flow. As a result, the toner is supplied to the hopper 18.

Since the toner is forced to flow out using the slope 46, the present invention has the advantage of allowing the toner bottle 15 to transmit the toner with a constant or consistent quantity in a more stable or even manner than a toner bottle with a conventional spiral rib, as depicted in FIG. 1.

Figure 5:
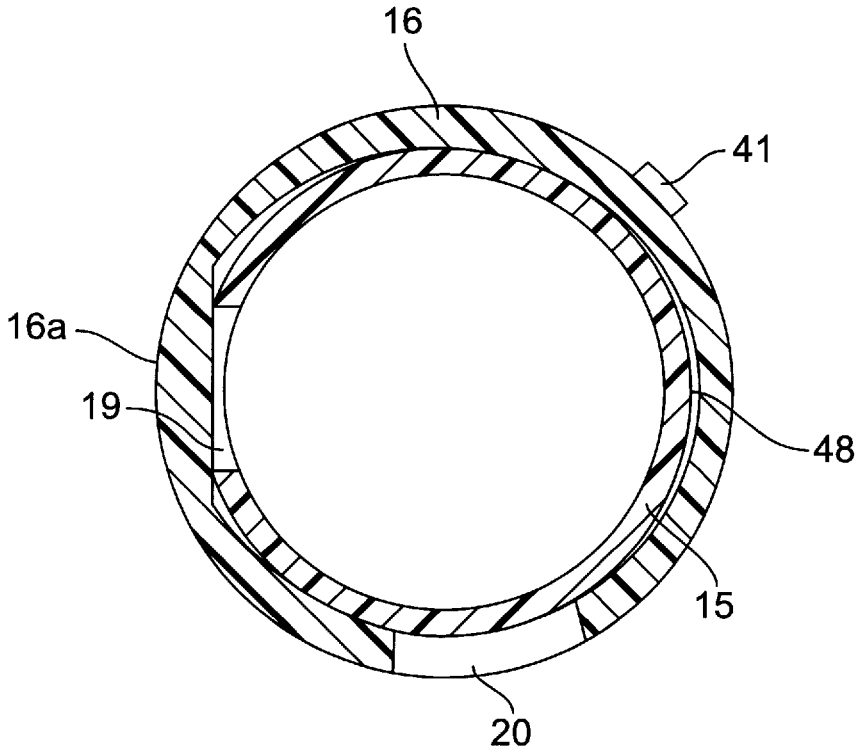
FIG. 5 is a cross section of a shutter and a tip of the toner bottle of the present invention.

FIG. 5 is a cross section depicting another exemplary embodiment of the present invention. The shutter 16, which is rotatably disposed on the toner bottle 15, is made of plastic so that the shutter 16 can be elastic. The shutter 16 is formed with an arc 16*a* that is thicker than the rest of the shutter. When the toner bottle 15 is not in use, the opening 19 thereof is closed by the thicker arc 16*a*. Since the shutter 16 is elastic, the opening 19 is firmly closed by the thicker arc 16 although some gaps 48 are produced in other parts, thereby preventing the toner from spilling from the opening 19 through any gaps to dirty the user's hands or any periphery devices.

When the toner bottle 15 is put in use, the engaging protrusion 41 of the shutter 16 engages with the convex slit 44 of the toner bottle holder 17, thus keeping the shutter 16 from rotating relative to the toner bottle holder. Only the toner bottle 15 rotates to move the opening 19 of toner bottle 15 to the opening 20 of shutter 16. During such rotation, the inner diameter of the shutter becomes extended by the thickness of the thicker arc 16*a*. The shutter 16 deforms elastically by the gap 48 and the rotation of the toner bottle 15 is not impeded.

Further, another exemplary embodiment is described by referring to FIGS. 6–9.

Figure 6:
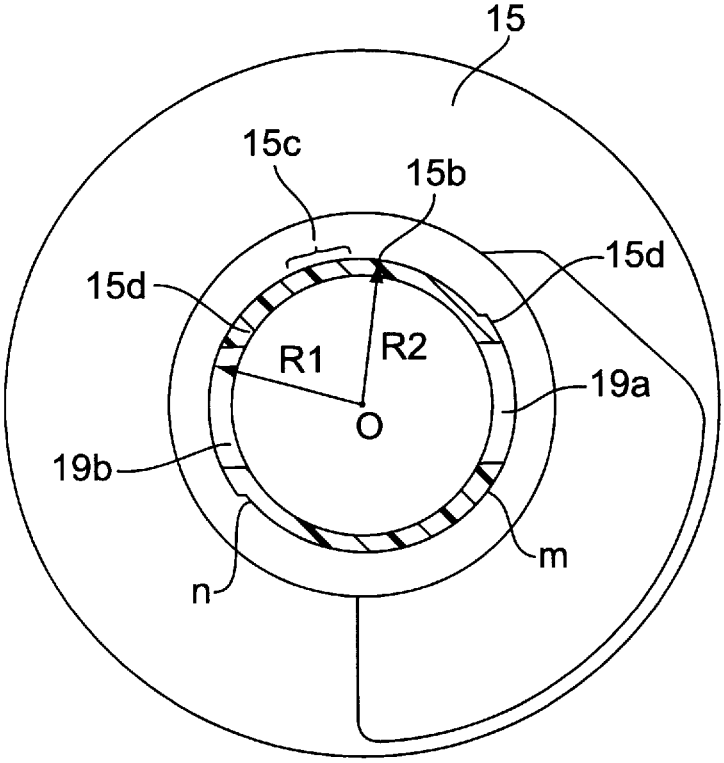
FIG. 6 is a cross section of the tip of the toner bottle of the present invention.
Figure 7:
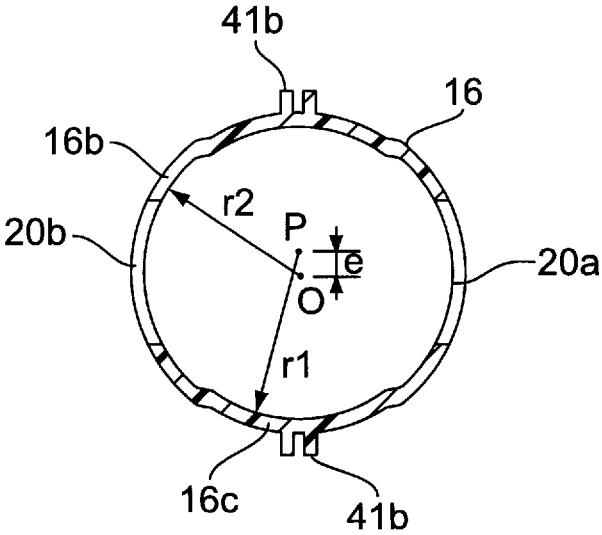
FIG. 7 is a cross section of a shutter of the present invention.

FIG. 6 is a cross section of the tip of toner bottle 15. FIG. 7 is a cross section of shutter 16 for opening/closing the opening 19 of the toner bottle for allowing the toner to flow. The shutter 16 is mounted on the tip of toner bottle 15.

In FIG. 6, the toner bottle 15 made of polyethylene, polypropylene, or vinyl chloride, and the tip thereof has two openings 19*a*, 19*b* from which toner may flow. The peripheries 15*d* of openings 19*a*, 19*b* are thicker than the other arc portions of the tip. The outer radius R1 is designed to be longer than the outer radius R2 of the arc 15*b* at the approximate center. An arc 15*c* between the two openings 19*a*, 19*b* is formed with radiuses continuously and gradually changing from R1 to R2. To be more specific, a first end "m" of periphery of the first opening 19*a* is made thicker than a second end "n" of the second opening 19*b*. The thickness of the arc increases gradually and continuously from "n" to "m". The counterpart arc on the other side is formed in the same manner. The shape of this thicker arc is not limited to the embodiment depicted in FIG. 6, but the shape may be in any form as long as the periphery 15*d* of the openings 19*a*, 19*b* are made thicker than the other peripheries of the tip portion of the toner bottle.

As shown in FIG. 7, two openings 20*a*, 20*b* and two protrusions 41*a*, 41*b* are formed in the shutter 16. An arc 16*c* (sealed part) is formed with an inner radius of r1 having a center that is P, which is deviated from the origin center 0 by "e". A periphery 16*b* containing the opening 20*b* is formed with an inner radius r2 from the origin center 0.

Figure 8:
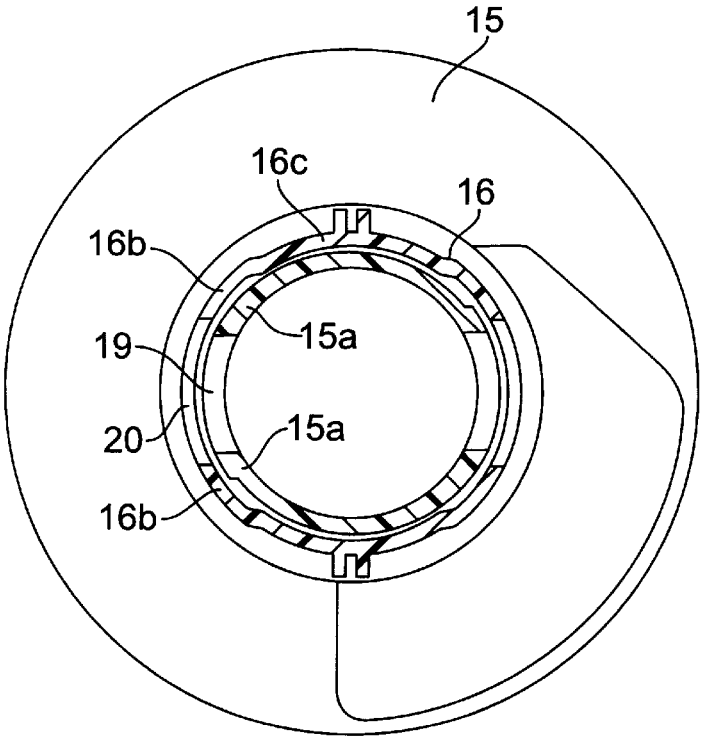
FIG. 8 is a cross section depicting a relationship between the tip of a toner bottle and the shutter of the present invention when the opening in the tip of the toner bottle is uncovered.
Figure 9:
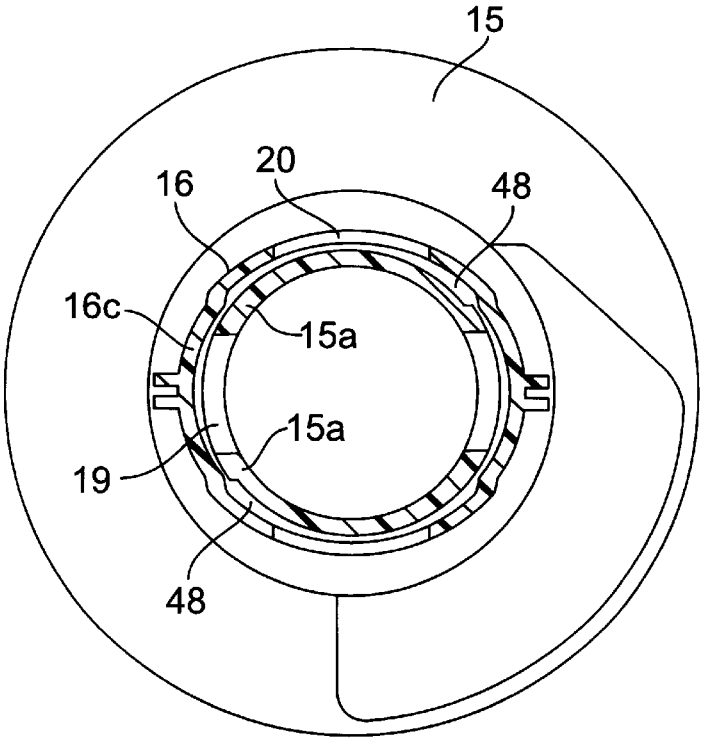
FIG. 9 is a cross section also depicting a relationship between the tip of toner bottle and the shutter of the present invention when the opening in the tip of the toner bottle is covered.

FIG. 8 and FIG. 9 are cross sections depicting the shutter 16 in different positions relative to the toner bottle 15. Specifically, FIG. 8 depicts that the shutter 16 in an open position, and FIG. 9 depicts that the shutter 16 in a closed position.

As described before, the radius r1 of the arc 16*c* (sealed part) situated between the openings 20*a*, 20*b* has the following relationship with the radius R1 of the periphery 15*d* of an opening in the toner bottle: R1>r1−e Based on the above relation, the shutter 16, which may be made of polypropylene, polyethylene, ABS resin or polystyrene is deformed elastically. Thus, the shutter 16 can close the opening 19 of toner bottle 15 firmly with the arc 16*a* thereof, thereby preventing the toner bottle 15 from spilling the toner accidentally.

The inner radius r2 of periphery 16*b* containing an opening on the shutter 16 has the following relationship with the outer radius R2 of arc 15*b* of the toner bottle 15: r2>R2

Accordingly, as shown in FIG. 8, the shutter 16 elastically deforms itself by the distance of gap 48 between the toner bottle 15 and the shutter. Hence, the shutter 16 can open/close smoothly without affecting the rotating operation of the shutter 16.

When the toner bottle 15 is fitted in the toner bottle holder, the engaging protrusion 41 engages with the convex slit 44 of toner bottle holder 17. Accordingly, the shutter 16 does not rotate and only the toner bottle 15 rotates to move its opening 19 under the opening 20 of shutter 16. When the openings of the toner bottle and the shutter are in this position, toner may be supplied from the toner bottle 15 to the development device 35.

Figure 10:
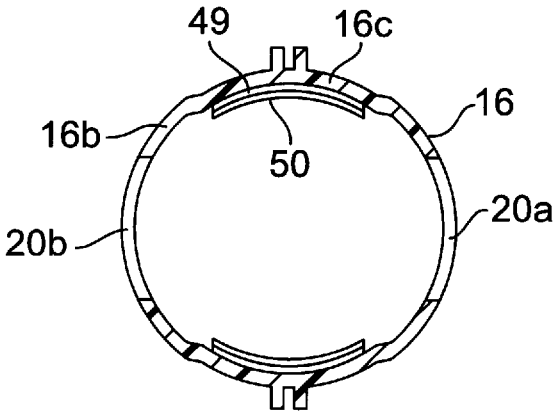
FIG. 10 is a cross section depicting another exemplary embodiment of the shutter of the toner supplying apparatus of the present invention featuring an elastic layer on the inside of the shutter.

FIG. 10 is a cross section depicting another embodiment of shutter 16. In this embodiment, an elastic member such as a sponge or rubber is situated on the inside wall of the arc portion (sealed part) of the shutter 16 to provide a close airtightness. To be more specific, an elastic sealing member 49 made of foamed rubber, such as urethane-sponge, and a sliding sheet 50, form a dual-layer sealing member. This sealing member is put on the inner wall of arc 16*c* to increase airtightness as well to make it easier to rotate the toner bottle relative to the shutter ring, as by reducing the friction between the arc portion of the shutter and the toner bottle.

Figure 11:
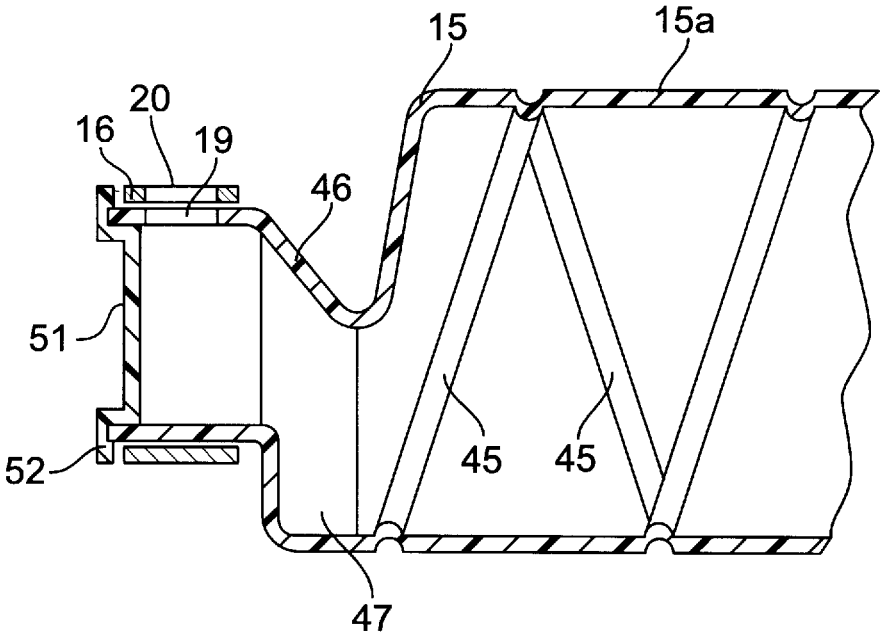
FIG. 11 is a cross section depicting another exemplary embodiment of the toner bottle of the present invention featuring a lid for the tip of the toner bottle.

FIG. 11 is a cross section depicting still another embodiment of a toner bottle according to the present invention. The opening on the tip of the toner bottle 15 is covered by a lid 51 made of the same resin material as that of the toner bottle 15. The lid 51 is detachable from the tip for loading the toner bottle 15 with toner. The lid 51 is capped onto the tip of toner bottle 15 with a collar 52 of lid 51. The outer diameter of collar 52 is larger than that of the toner bottle tip. Thus, the shutter 16 is prevented from coming off the tip and its movement is confined to a rotatable movement around the tip.

According to the above structure, when inserting the shutter 16, the toner bottle 15 can be rotatably held with the shoulder part thereof, the lid 51, and the collar 52. As a result, a complex mechanism of rotatable holder can be omitted.

Of course, it should be understood that a wide range of changes and modifications can be made to the preferred embodiment described above and that the foregoing description be regarded as illustrative rather than limiting. It is therefore intended that it is the following claims, including all equivalents, which are intended to define the scope of this invention.

What is claimed is:

1. A toner bottle comprising:

(a) a body having a convexly-shaped spiral rib formed continuously on the inside face thereof, said body having a longitudinal axis;

(b) a tip having an opening in a side thereof for allowing toner to flow, said opening extending substantially parallel to said longitudinal axis of said body;

(c) a section joining said body and said tip having a first circular face with a convexly shaped slope sloping toward the inside of the section, and a second circular face with a toner pump-up portion having a diameter that is approximately the same as that of said body; and (d) a circular shutter surrounding said tip, said shutter being rotated about said tip and having an opening, wherein said shutter normally closes the tip opening, except when the tip opening is moved under the shutter opening.

2. A toner bottle comprising;

(a) a bottle having a tip with an opening for toner to flow therefrom; and (b) a shutter having an opening,
said shutter rotatably disposed over the tip for closing and opening the tip opening,
said shutter being made of elastic, and
said shutter having an arc part that is made thicker than other parts of the shutter, wherein the tip opening is closed by the thicker arc of said shutter.

3. A toner bottle comprising:

(a) a bottle having a tip with an opening therein for allowing toner to flow from the bottle,
wherein a periphery of the tip opening is made thicker than other peripheries of the tip; and (b) a shutter rotatably disposed on the tip for opening and closing the tip opening,
wherein said shutter has an opening that fits over the tip opening,
wherein said shutter is elastic and normally closes the tip opening, except when the tip opening is moved under the shutter opening.

4. A toner bottle comprising:

(a) a bottle having a tip with an opening therein for allowing toner to flow from the bottle;
wherein a periphery of the tip opening is made gradually thicker from a first part of a circle to a second part thereof; and (b) a shutter rotatably disposed on the tip for opening and closing the tip opening,
wherein said shutter has an opening that fits over the tip opening,
wherein said shutter is elastic and normally closes the tip opening, except when the tip opening is moved under the shutter opening.

5. A toner bottle comprising:

(a) a bottle having a tip with an opening therein for allowing toner to flow from the bottle,
wherein a periphery of the tip opening is made thicker than other peripheries of the tip; and (b) a shutter rotatably disposed on the tip for opening and closing the tip opening,
wherein said shutter has an opening that fits over the tip opening,
wherein said shutter is elastic and normally closes the tip opening, except when the tip opening is moved under the shutter opening, and wherein the tip and shutter have the following relationship:

$$R1>r1-e,\ r2>R2,$$

where,

R1 is the outer radius of the periphery of the tip opening of the toner bottle,

R2 is the outer radius of the approximate center of the tip, r1 is the inner radius of an arc of the shutter taken from a center of the shutter that is deviated from an origin center of the shutter by a distance "e", and r2 is the inner radius of a periphery of the shutter opening taken from the center of the shutter.

6. A toner bottle comprising:

(a) a bottle having a tip with an opening for toner to flow therefrom;

(b) a shutter having an opening,
said shutter rotatably disposed over the tip for closing and opening the tip opening; and (c) a lid detachably disposed on the tip of said bottle, for preventing said shutter from falling off the tip.

7. The toner bottle of claim 6, wherein said lid has a collar with a diameter that is larger than the diameter of the tip of the toner bottle.

8. A toner bottle comprising:

(a) a bottle having a tip with an opening therein for allowing toner to flow from the bottle;
wherein a periphery of the tip opening is made gradually thicker from a first part of a circle to a second part thereof; and (b) a shutter rotatably disposed on the tip for opening and closing the tip opening,
wherein said shutter has an opening that fits over the tip opening,
wherein said shutter is elastic and normally closes the tip opening, except when the tip opening is rotated under the shutter opening, and
wherein said shutter has an elastic member on an inside wall thereof to reduce friction between the tip and the shutter during rotation.

9. The toner bottle of claim 8, wherein said elastic member comprises dual layers comprising an elastic sealing member and a sliding sheet.

10. A toner supplying apparatus comprising:

(a) a toner bottle held by a bottle holder, said bottle having an opening therein for allowing toner to flow therefrom through an opening in the bottle holder;

(b) a hopper for holding the bottle holder and for rotating the bottle holder;

(c) a rotatable shaft capable of being rotated in a forward direction and in a reverse direction;

(d) a toner supplying roller disposed in said hopper for supplying toner to a development device when said rotatable shaft rotates forward; and (e) rotating means for rotating said bottle holder when said rotatable shaft rotates in reverse and for allowing toner to flow from the toner bottle to the hopper, wherein said toner bottle comprises:
(i) a body having a convexly-shaped spiral rib continuously formed on the inside face thereof;
(ii) a tip with an opening therein for allowing toner to flow from the bottle;
(iii) a section joining the body and the tip comprising,
a first circular face having a convex portion sloping toward the inside, and
a second circular face having a toner pump-up portion with a diameter that is approximately the same as that of the body; and
(iv) a shutter having an opening, said shutter rotatably disposed over the tip for closing and opening the tip opening.

11. The toner supplying apparatus of claim 10, wherein a protrusion is formed on a side of said shutter and a convex slit is formed on an inside face of the bottle holder, and wherein when the toner bottle is inserted into the bottle holder, the protrusion formed on the shutter engages said convex slit to prevent the shutter from rotating independently of the bottle holder.

* * * * *